US005640985A

United States Patent [19]

Snyder et al.

[11] Patent Number: 5,640,985

[45] Date of Patent: Jun. 24, 1997

[54] CANE WITH GRASPING APPARATUS

[75] Inventors: Kent Snyder, River Forest; Max J. Winz, Hodgkins; Robert Sparkowski, Schaumburg, all of Ill.

[73] Assignee: Profit Building Services, Inc., Franklin Park, Ill.

[21] Appl. No.: 583,187

[22] Filed: Jan. 4, 1996

Related U.S. Application Data

[63] Continuation-in-part of Ser. No. 309,669, Sep. 21, 1994, abandoned.

[51] Int. Cl.[6] ..... A45B 3/00

[52] U.S. Cl. ..... 135/65; 135/66; 135/84

[58] Field of Search ..... 135/66, 65, 72, 135/77, 84

[56] References Cited

U.S. PATENT DOCUMENTS

| | | | |
|---|---|---|---|
| 2,346,038 | 4/1944 | Mason . | |
| 2,836,188 | 5/1958 | Jordan . | |
| 3,093,402 | 6/1963 | Sisson | 135/65 X |
| 3,467,116 | 9/1969 | Ringewaldt | 135/66 X |
| 3,738,674 | 6/1973 | Pauls | 135/66 X |
| 3,763,872 | 10/1973 | Gooley . | |
| 4,299,246 | 11/1981 | Marsh | 135/66 |
| 4,434,808 | 3/1984 | Burak . | |
| 4,527,824 | 7/1985 | Rosenfeld . | |
| 4,811,750 | 3/1989 | McAllister . | |
| 4,827,956 | 5/1989 | Toot . | |
| 4,966,316 | 10/1990 | George et al. | 135/66 X |
| 5,176,160 | 1/1993 | Osborn | 135/66 |
| 5,392,800 | 2/1995 | Sergi | 135/65 |

*Primary Examiner*—Lanna Mai

*Attorney, Agent, or Firm*—Laff, Whitesel, Conte & Saret, Ltd.

[57] ABSTRACT

An adjustable-length cane with a grasping apparatus includes a trigger at one end of the cane and a finger at the other end. The trigger and the finger are pivotally mounted within the body of the cane and have portions extending out of the cane body through slots. A cord and pulley system within the cane body connects the trigger and the finger so that when the trigger is activated, the finger closes or opens to either grasp or release objects. The finger includes a locking clip or similar device which holds the cord at a preselected point. This feature allows the user to vary the amount that the finger opens, and it allows the grasping apparatus to operate optimally irrespective of the length of the cane. The grasping apparatus may be locked in the closed position by appropriately sliding a sleeve into a locking zone on the trigger.

13 Claims, 5 Drawing Sheets

CANE WITH GRASPING APPARATUS

This application is a continuation in part of application Ser. No. 08/309,669, filed Sep. 21, 1994, abandoned.

FIELD

This invention relates generally to canes, and more specifically, to a cane with a grasping apparatus.

BACKGROUND

Persons who need the assistance of canes in order to move about often must avoid flexing the legs, waist, or torso to reach for or grasp objects. In order words, such persons have difficulty bending or moving to pick up objects. For example, a person using a cane while recovering from a hip injury cannot bend down to pick things up from the floor.

There are various devices available for those who need to reach and grasp objects without bending or flexing ailing limbs or muscles. Generally, these grasping devices have a handle with a trigger, an arm extending from the handle, and a clamp at the other end of the arm. The trigger and the clamp both are interconnected so that when the trigger is operated the clamp can be selectively opened and closed when reaching for objects.

The above described grasping devices are impractical for use by people who need canes to move about. In particular, when a person walking with a cane chances upon an object that he wants to grasp or pick-up, he will have to walk to wherever he has placed his grasping device, retrieve the grasping device, and then walk back to where the object was located. These extra trips would be an inconvenience even for a fully ambulatory individual. For someone needing a cane while making these trips, the trips are not only inconvenient, but no doubt painful as well. In addition, a person walking with the assistance of a cane has great difficulty carrying the grasping device, which tends to be rather long, while also grasping the cane to move around.

Previous attempts at overcoming the limitations and inconveniences of these grasping devices have themselves been impractical and unsatisfactory. For example, efforts have been made to combine a reaching apparatus with a walking cane; but these combinations, among other disadvantages, are complex to manufacture and difficult for the user to operate. (See Jordan U.S. Pat. No. 2,836,188, Mason U.S. Pat. No. 2,346,038, and Osborne U.S. Pat. No. 5,176,160.) The combination devices known in the art have the further disadvantage of either reducing the structural integrity of the cane in order to include the reaching apparatus or appending the reaching apparatus to the exterior of the cane in such a way that the reaching apparatus may pose a safety hazard to the user of the cane. The combination devices are also too heavy to be easily manipulated by an ailing person to retrieve objects.

Accordingly, there is a need for a cane with a grasping apparatus which permits the user to safely and conveniently walk about with the assistance of a cane and also reach for and grasp desired objects with the grasping apparatus during such walking.

There is also a need for a cane with a grasping apparatus which is lightweight and easily manufactured.

SUMMARY

Accordingly, an object of this invention is to provide a new and improved cane with a grasping apparatus incorporated therein.

According to one aspect of the present invention, the foregoing and other objects and advantages are attained by a cane which includes a body and a trigger mounted in the body. The trigger pivots about an axis located within the body and is connected to a finger which is also pivotally mounted within the body. When the trigger is operated, the finger pivots toward and away from the body of the cane in order to grasp or release objects.

According to another aspect of the invention, the body of the cane is made of a cylindrical tube. The tube has a bore extending through it, and part of the bore runs between the trigger and the finger. Placed within the bore is a pulley located near the trigger and another pulley located near the finger. A flexible, elongated member, such as a cord runs over the pulleys and has one end connected to the trigger and the other end connected to the finger.

In accordance with still another aspect of the invention, a hook is mounted to the finger so that a channel is defined between the hook and the finger. The cord referred to above can be placed snugly into the channel so that the cord is held in the channel at a selected point. This feature allows the user to vary the amount that the finger opens, and it also allows the finger to be locked into a closed position.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawings in which.

DESCRIPTION

Figure 1:
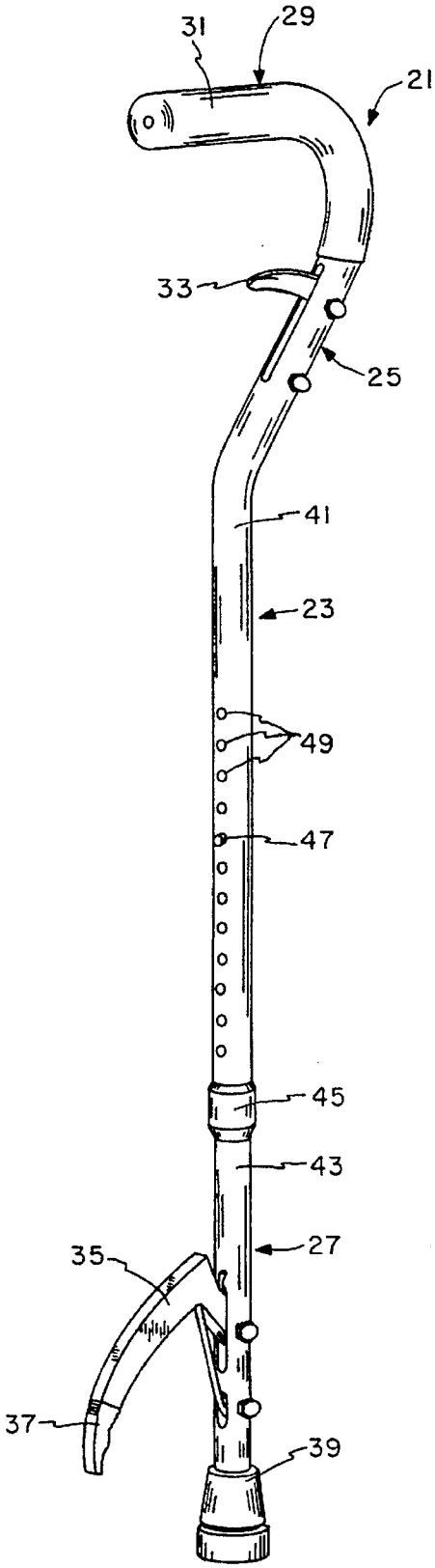
FIG. 1 is a perspective view of a cane incorporating the principles of the invention.

As shown in FIG. 1, a cane 21 includes a body 23. The body 23 has an upper end 25 and a lower end 27. The upper end 25 of the body 23 terminates in a handle 29, and the handle 29 is sheathed with a hand grip 31 made of a material suitable for a user to grasp without having the user's hand slip over the hand grip 31, such as resiliently compressible foam material or other suitable, flexible, polymeric material. The lower end 27 of the body 23 terminates in a cane tip 39.

A trigger 33 is located at the upper end 25 within the body 23 so that the trigger 33 can be reached by the operator's fingers while the operator's hand is resting on the hand grip 31. A finger 35 is pivotally mounted within the body 23 at the lower end 27. The finger 35 extends outwardly from the body 23 and terminates in a finger tip 37. The trigger 33 and the finger 35 are connected to each other by means discussed below and thereby serve as a grasping apparatus 48 (FIG. 3A) in the cane 21.

The body 23 is formed by a pair of cylindrical telescoping tubes 41, 43. The length of the cane 21 can be adjusted by loosening a collar 45 located between the tubes 41, 43, depressing a button 47, and sliding the tubes 41, 43 in relation to each other to either shorten or lengthen the cane 21. Once the tubes 41, 43 have been slid to the appropriate positions, they are adjusted so that the button 47 re-engages the nearest of holes 49, thereby locking the tubes 41, 43 in relative position to each other. The collar 45 is retightened to further assure that the tubes 41, 43 will remain fixed in relation to each other.

Figure 3A:
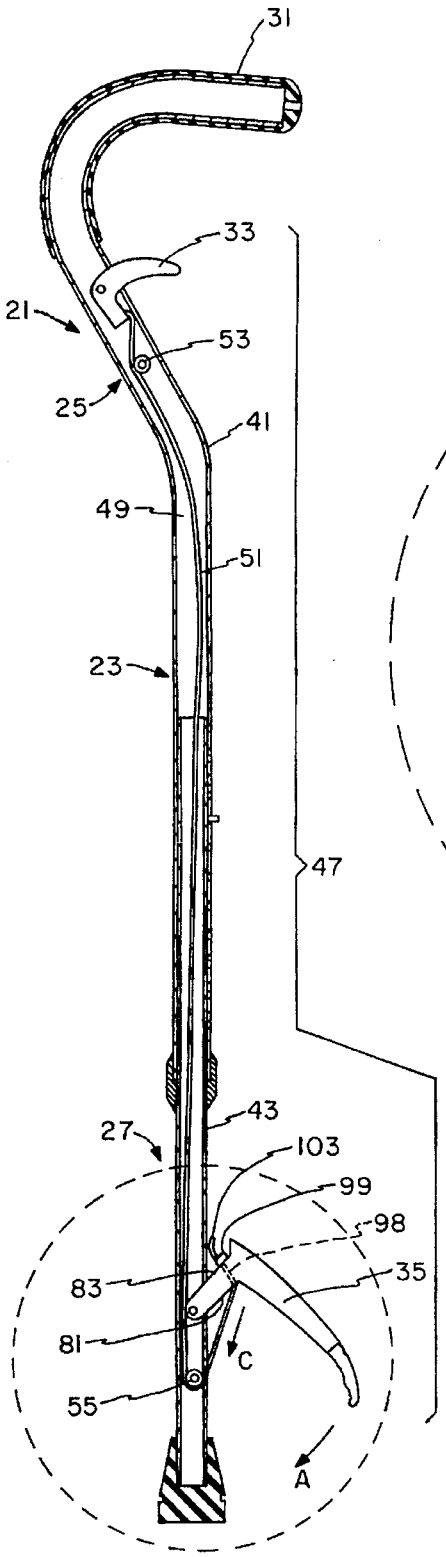
FIGS. 3A and 3B are sectional side views of the cane of FIG. 1.

Referring to FIG. 3A, within the tubes 41, 43 is a bore 49 which extends within the body 23 and between the trigger 33 and the finger 35. Means, here shown as a flexible, elongated member or cord 51, are provided for connecting the trigger 33 and the finger 35. One end of the cord 51 is attached to the trigger 33, and the other end of the cord 51 is attached to the finger 35. The cord 51 runs over pulleys 53, 55, with the pulley 53 being located near the trigger 33 and the pulley 55 being located near the finger 35.

Figure 2:
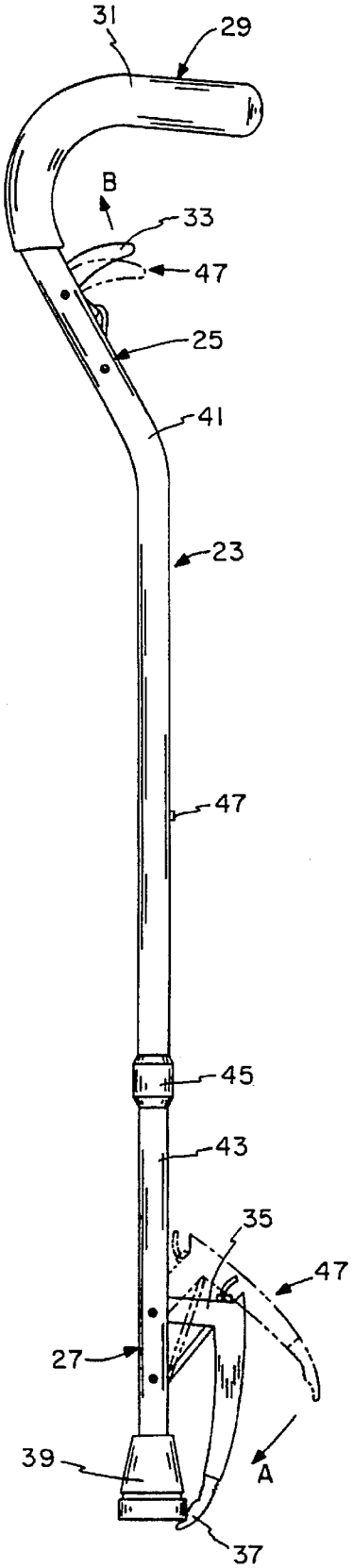
FIG. 2 is a side view of the cane of FIG. 1.

The operation of the grasping apparatus 48 can be explained with reference to FIG. 2. The trigger 33 and the finger 35 of the grasping apparatus 48 are shown in phantom lines in their opened or unactivated position. When the trigger 33 is pulled toward the handle 29 in the direction indicated by arrow B, the finger 35 pivots in the direction indicated by arrow A. The finger 35 continues to pivot in response to the activation of the trigger 33 until the finger tip 37 is brought against the cane tip 39 as seen by the solid lines in FIG. 2. It will be appreciated that objects (not shown) can be grasped by causing the finger 35 to move in the direction of the arrow A a distance sufficient to clamp the objects between the finger 35 and the lower end 27 of the body 23.

Figure 4:
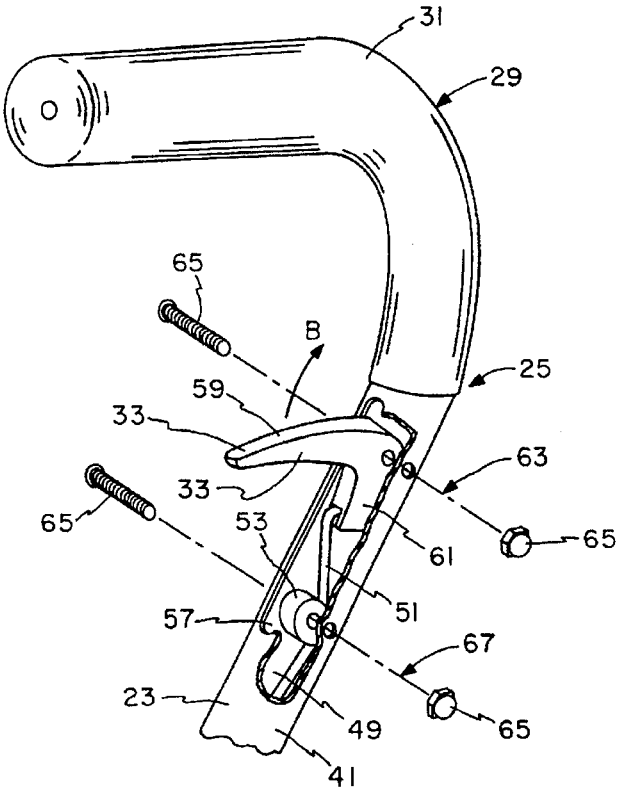
FIG. 4 is an exploded, perspective view of the upper end of the cane of FIG. 1.

As seen in FIG. 4, the trigger 33 is generally L-shaped, and has a trigger end 59 and a trigger base 61. The trigger 33 is located in a slot 57 so that the trigger end 59 extends outwardly from the slot 57 and the body 23. The slot 57 communicates with the bore 49. The trigger base 61 extends generally perpendicularly to the trigger end 59 and is substantially within the slot 57 when the trigger is in the unactivated position as shown in FIG. 4. The trigger 33 is pivotally mounted about an axis 63 by a fastener 65, such as a nut and bolt. The axis 63 about which the trigger 33 pivots is generally located at the intersection of the trigger end 59 and the trigger base 61.

The end of the cord 51 is attached to the base 61 of the trigger 33 by any suitable means. The pulley 53 is mounted about an axis 67 below and proximate to the trigger 33 by another of the fasteners 65. The axis 67 is parallel to the axis 63. In this way, when the trigger 33 is pivoted in the direction indicated by the arrow B, the cord 51 is pulled through the bore 49, generally in the direction of the handle 29, and along the pulley 53. As seen in FIG. 3A, the cord 51 extends from the trigger 33, over the pulley 53, through the bore 49, and over the pulley 55 at the lower end 27.

Figure 5:
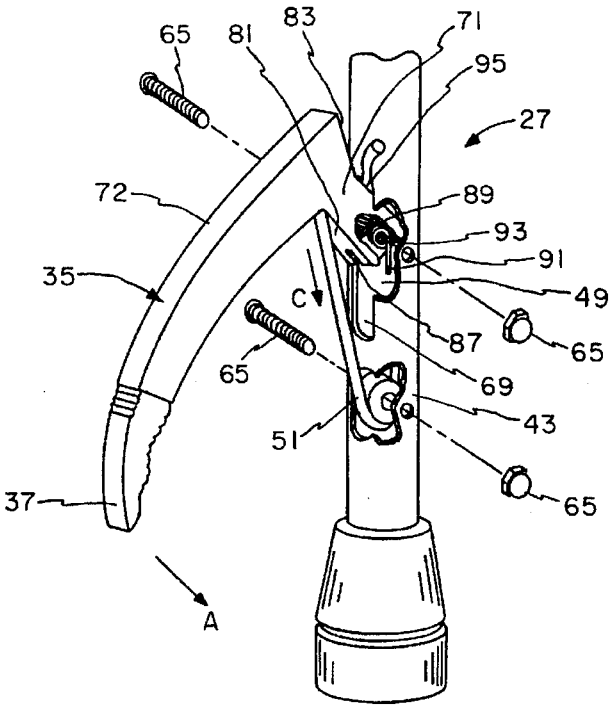
FIG. 5 is an exploded, perspective view of the lower end of the cane of FIG. 1.

Referring now to FIG. 5, the lower end 27 of the cane 21 includes a slot 69 in communication with the bore 49. The finger 35 is generally L-shaped, and includes a finger segment 71, at least partially received in the slot 69, and an extending segment 72, generally perpendicular to the segment 71 and terminating in the finger tip 37. The finger 35 is pivotally mounted to the body 23 about an axis 73 by one of the fasteners 65. The axis 73 runs through the segment 71 of the finger 35 and is parallel to the axes 63, 67.

The pulley 55 is mounted about an axis 75 by another of the fasteners 65. The axis 75 for the pulley 55 is located further from the trigger 63 than the axis 73 about which the finger 35 pivots, and the axis 75 is parallel to the axes 73, 67, 63.

The cord 51 exits the bore 49 through a slot 77 (FIG. 5) and communicates with the bore 49 which is located adjacent the pulley 55. The end of the cord 51 is attached to the finger 35 (as described more fully below) at a point 79, the point 79 being generally located where the segment 71 joins the segment 72. The point 79 is radially spaced from the axis 73 about which the finger 35 pivots. The cord 51 extends through a bore 98 (FIGS. 3A and 3B) in the finger 35. The bore 98 extends from inner finger surface 81 to outer finger surface 83.

Still referring to FIG. 5, one of the ends of the segment 71 includes a channel 87. A spring 85 is received within the channel 87. The spring 85 includes arms 89, 91 which extend radially from a central coil 93. The central coil 93 has an axis of cylindrical symmetry and the spring 85 is positioned within the channel 87 so that the axis of the central coil 93 is co-axial with the axis 73 of the finger 35. The arm 91 of the spring 85 is biased against the body 23, and the arm 89 is biased against the base of the channel 87, thereby biasing the finger 35 in an opened position. The maximum amount by which the spring 85 can bias open the finger 35 is limited by contact between the outer finger surface 83 and an upper edge 95 of the slot 69.

The operation of the cane and grasping apparatus is now apparent from the above description. When the trigger 33 is pivoted in the direction of the arrow B (FIG. 4), the cord 51 is pulled generally within the bore 49 and toward the handle 29. At the lower end 27 of the cane 21, the cord 51 is pulled in the direction indicated by arrow C. Since the cord 51 is attached to the finger 35 at the point 79, radially spaced from the pivot axis 73 of the finger 35, the finger 35 is caused to pivot in the direction indicated by the arrow A (FIG. 5). Objects (not shown) are grasped between the finger 35 and the lower end 27 of the cane 21. The location of the point 79 and the placement of the finger 35 in the slot 69 mean that the finger 35 generally pivots through an arc of less than 90 degrees. This is sufficient for most objects to be retrieved, and it also means that the trigger 33 does not have to be pulled a great distance in the direction of the arrow B (FIG. 2) in order for the user to grasp an object.

Figure 3B:
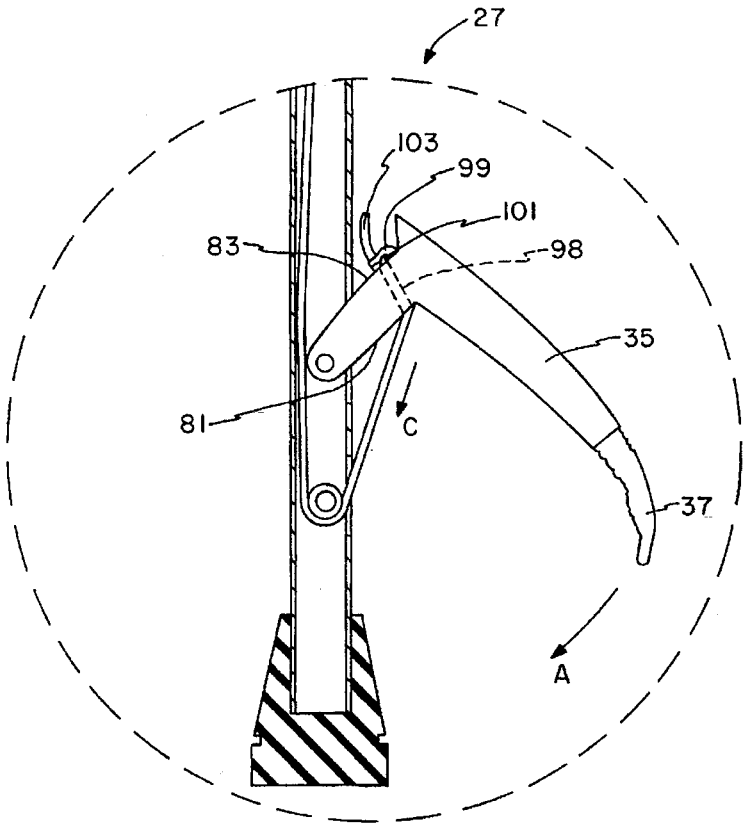

Referring now to FIG. 3B, the finger 35 has a hook 99 protruding slightly from and extending parallel to the finger surface 83. The space between the hook 99 and the finger surface 83 defines a channel 101. The channel 101 is sized to form an interference fit with the cord 51 and is located proximate to the bore 98. Thus the hook 99 and the channel 101 provide a means for retaining the cord 51 at a predetermined point on the length of the cord 51.

This retaining means feature allows the length of the cord 51 between the finger 35 and the trigger 33 to be varied so as to perform several useful functions described in more detail below. The retaining means also anchors the cord 51 to the finger 35 so that the finger 35 pivots when the cord 51 is pulled in the direction of the arrow C. (A knot (not shown) may also be tied at the end of the cord 51 to further anchor it to the finger 35.)

The hook 99 and the channel 101, by retaining the cord 51 at a predetermined point can be used to lock the finger 35 in the closed position. To accomplish this, the cord 51 is disengaged from the channel 101, and the finger 51 is moved in the direction of the arrow A until it is against the cane tip 39, i.e., in the closed position. The movement of the finger 51 while the cord 51 is disengaged from the channel 101 results in some slack in the cord 51. This slack is taken up by the operator pulling the cord 51 through the bore 98 in the direction opposite the arrow C. Once the slack is taken up, the cord 51 is reinserted into the channel 101 at the point on the cord 51 now adjacent the hook 99, thereby retaining the cord 51 at a pre-selected point and locking the finger 35 in the closed position.

The above-described procedure for locking the finger 51 with the hook 99 and the channel 101 can be varied to accomplish other useful adjustments to the grasping apparatus 48. For example, the amount the finger 35 opens may be reduced by following the above-described procedure except that the finger 35 is pivoted partially toward the cane tip 39 until it is in the position desired by the operator, after which the slack in the cord 51 is taken up as described above.

The retaining means of the hook 99 and the channel 101 also allow the grasping apparatus 48 to function optimally even when the cane has been adjusted to different lengths. As can best be appreciated by referring to FIG. 3A, slack in the cord 51 is created when the cane 21 is adjusted as described earlier to have a shorter length. Depending on the extent to which the cane 21 has been shortened, this slack in the cord 51 may result in the trigger 31 no longer being able to pivot sufficiently so as to cause the finger 35 to pivot. To remedy this situation, the slack in the cord 51 is pulled in the direction opposite the arrow C, as described previously, until the cord 51 is sufficiently taut between the trigger 33 and the finger 35 to permit the trigger 33 to activate the finger 35.

As best seen in FIG. 3B, the slack of the cord 51 appears as cord segment 103 which extends away from the channel 101. If the cane 21 is adjusted to be longer, then part or all of the segment 103 can be used to lengthen the cord 51 and thereby assure optimal operation of the grasping device 47.

Another preferred embodiment according to the present invention is shown in FIGS. 6–10. A cane 121, like the cane 21 of the previous embodiment, has an elongated body 123, a bore 149 extending through the body 123, and a handle 129 at the upper end of the body 123. The cane 121 includes a trigger 133 and a finger 135 connected by a flexible, elongated member, such as a cord 151, to form a grasping apparatus 147.

Figure 6:
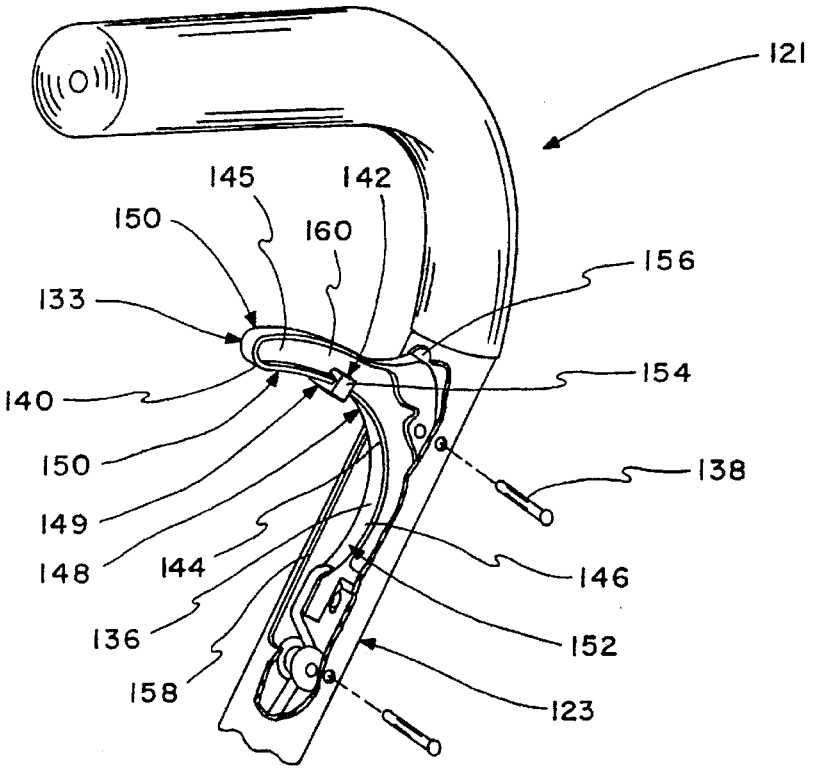
FIG. 6 is a perspective, partial view of an alternative embodiment according to the present invention.
Figure 7:
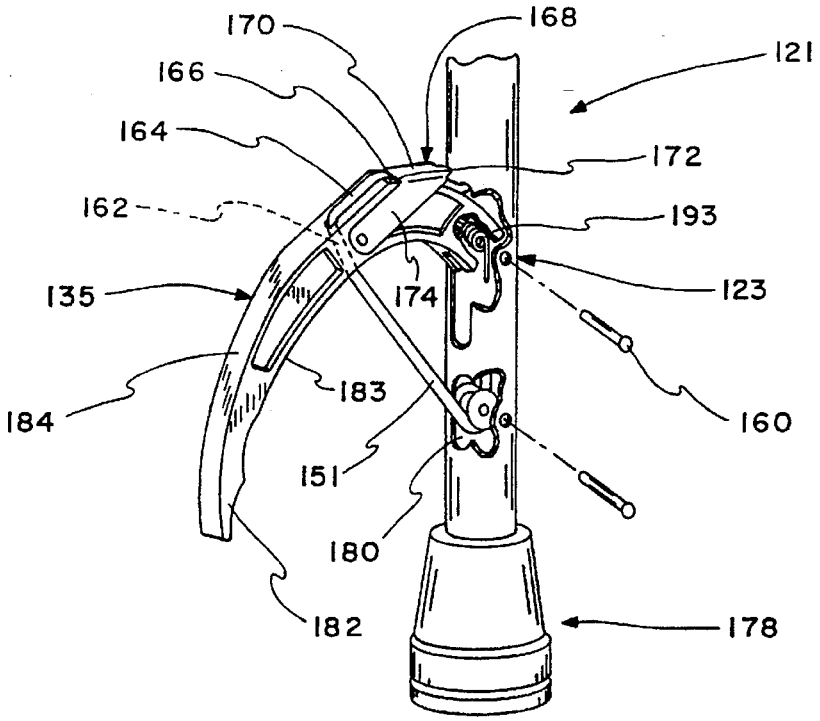
FIG. 7 is a perspective view of another portion of the alternative embodiment of FIG. 6.
Figure 8:
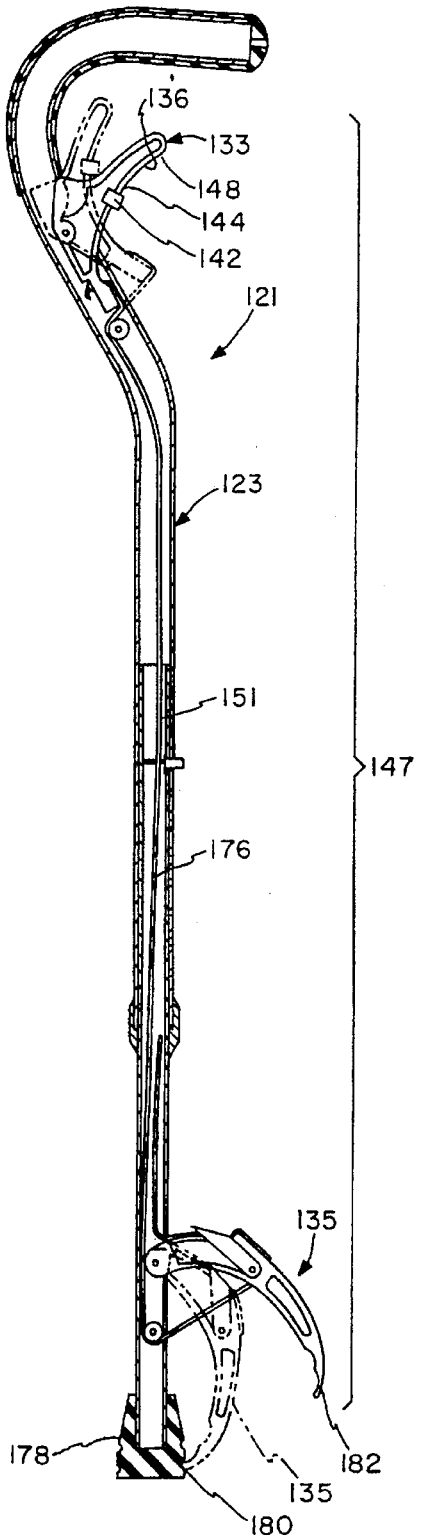
FIG. 8 is a side sectional view of the embodiment of FIGS. 6 and 7.

The trigger 133, the finger 135, and the grasping apparatus 147 formed thereby include additional features not found in the cane 21 of the previous embodiment. The trigger 133 shown in FIGS. 6, 8, and 9 has been structured and adapted so that it can be locked in a predetermined position which, in turn, locks the finger 135 in the closed position shown by the phantom lines of FIG. 8. The finger 135 shown in FIGS. 7, 8, and 10 is structured and adapted so that the length of the cord 151 can be quickly and easily adjusted. This permits the cane 121 to have its length adjusted while still allowing the finger 135 to pivot between its open position shown in solid lines in FIG. 8 and its closed position shown in corresponding phantom lines. The ability to adjust the length of the cord 151 also permits the degree to which the finger 135 opens to be adjusted.

The trigger 133 will now be described in greater detail with particular reference to FIGS. 6, 8, and 9. The trigger 133 is pivotally mounted about pin 138 which extends through the body 123 of the cane 121. The trigger 133 is mounted so that its underside 148 pivots toward the cane body 123 as shown by the phantom lines of FIG. 8, and away from the body 123 as shown by the solid lines of FIG. 8.

The trigger 133 has a track 136 which extends along the underside 148. The track 136 includes a release zone 144 located toward upper trigger end 150, and a locking zone 146 located toward lower trigger end 152. A member or sleeve 142 is mounted on the track 133. The sleeve 142 may be slid along the track 133 by applying slight manual pressure to urge the sleeve 142 either toward the release zone 144 or toward the locking zone 146 as indicated by the directional arrows A (FIG. 9). When the sleeve 142 is in the release zone 144, as shown in FIGS. 6 and 8, the trigger 133 may be pivoted back and forth by the user to cause the finger 135 to pivot back and forth between the open and closed positions shown in FIG. 8. If the user desires to lock the finger 135 in a predetermined position, the sleeve 142 is slid into the locking zone 146, assumes the position shown in FIG. 9, and holds the trigger 133 in the position shown. The locking of the trigger 133 in this embodiment locks the finger 135 in the closed position shown in phantom lines in FIG. 8.

Further details of the track 136, the sleeve 142 slidably mounted thereon, and the body 123 will now be described, which will further show how the trigger 133 is locked into position when the sleeve 142 is in the locking zone 146. The track 136 includes a flange 140 which extends outwardly from opposite sides 145 of the trigger 133, as best seen in FIG. 6. Still referring to FIG. 6, the sleeve 142 has a back 149 and a pair of laterally spaced arms 154 terminating in tips 160. The sleeve 142 is thus generally C-shaped. The back 149 and the arms 154 engage the opposing surfaces of the flange 140.

The trigger 133 is mounted within a slot 156 in the body 123. The slot 156 has opposite longitudinal edges 158, one of which is shown in FIG. 6 and the other of which has been cut away for purposes of illustration. The opposite edges 158 are spaced so as to confront corresponding sides of the flange 140, but the edges 158 do not inhibit pivotal motion of the trigger 133.

Figure 9:
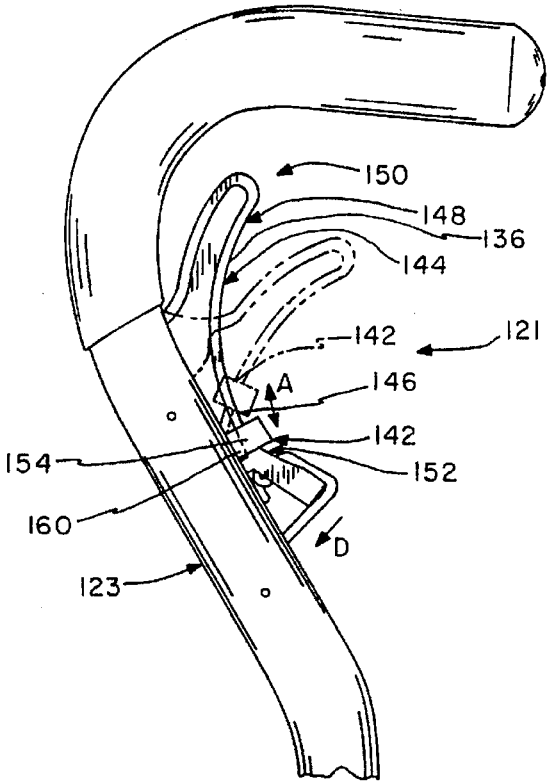
FIGS. 9 and 10 are partial, side elevational views of the embodiment shown in FIGS. 6–8.
Figure 10:
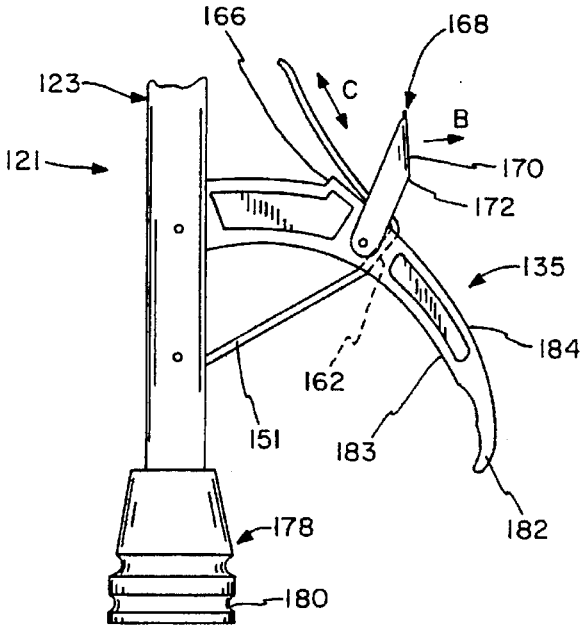

When the trigger 133 is pivoted to the predetermined position shown in solid lines in FIG. 9, the locking zone 146 is located near the outer surface of the body 123, but is sufficiently spaced therefrom to allow the tips 160 to become wedged between the track 136 and the body 123. The tips 160 contact the body 123 near the edges 158 of the slot 156. At the same time, the tips 160 engage the flange 140. As a result, the trigger 133 is locked in the predetermined position shown in solid lines in FIG. 9. The locking of the trigger 133, in turn, inhibits pivotal motion of the trigger 133 and thereby locks the finger 135 in a corresponding position, in this case the closed position shown by the phantom lines in FIG. 8.

The finger 135 will now be described with particular reference to FIG. 7, 8, and 10. As in the previous embodiment, the finger 135 is biased by the spring 93 (FIG. 7) in the open position. When the finger 135 is locked in the closed position as shown in phantom lines in FIG. 8, a spring force is transmitted up the cord 151 and subjects the lower end 152 of the trigger 133 to a force, generally indicated by the arrow D in FIG. 9, directed toward the cane body 123. This force acts to press the portion of the flange 140 at the locking zone 146 against the tips 160 of the sleeve 142 to further secure the sleeve 142 in its locking position shown in solid lines in FIG. 9.

The finger 135 is pivotally mounted about pin 160 which extends through the body 123 and is operatively connected to the trigger 133 by means of the cord 151. The cord 151 exits the body 123 at an aperture 180 (FIG. 7) below the pin 160. A bore 162 extends between inner and outer surfaces 183, 184 of the finger 135. The cord 151 passes through the bore 162. End portion 164 of the cord 151 passes out of the bore 162 and is sufficiently long to extend over the outer surface 184 of the finger 135 and across a ridge 166 thereon best seen in FIGS. 7 and 10.

A locking clip 168 is mounted to the finger 13 and is manually pivotable between a secure position shown in FIG. 7 and a release position shown in FIG. 10. The cord end portion 164 passes under the locking clip 168. The locking clip 168 is so sized and mounted to the finger 135 so that, when the locking clip is in the secure position shown in FIG. 7, it secures the cord 151 to the finger 135 by engaging the cord end portion 164 at the ridge 166 and proximate thereto. In particular, the locking clip 168 has a base 170 with an edge 172 which confronts the ridge 166 sufficiently closely to retain the cord end portion 164 in a snug-fit manner between the edge 172 and the ridge 166. The underside of the base 170 also engages the cord portion 164 to secure it against the outer surface 184 of the finger 135. The locking clip 168 has arms 174 extending from opposite sides of the base 170, and the locking clip 168 is mounted to the finger 135 at the ends of the arms 174.

The locking clip 168 may be pivoted from its secure position shown in FIG. 7 to its release position shown in FIG. 10 by applying suitable manual force in the direction of the arrow B of FIG. 10. In the release position, the cord 151 is released from the finger 135 and slidable in the directions indicated by the arrows C. This permits the amount of cord 151 between the trigger 133 and the finger 135 to be adjusted. The amount or predetermined length of cord 151 between the trigger 133 and the finger 135 is shown by reference numeral 176 in FIG. 8.

Adjustment of the predetermined length 176 allows the size of the opening between the finger 135 and lower tip 178 of the cane to be reduced from that shown in FIG. 10 by shortening the predetermined length 176. Adjustment of the predetermined length 176 can thus be used to vary the open position of the finger 135 to any amount between its outer limit position shown in FIG. 10 and its closed position shown in FIG. 8 in phantom lines.

The adjustment of the predetermined length 176 is also important when the overall length of the cane body 123 is adjusted. For example, if the cane as shown in FIG. 8 is made longer, the finger 135 would undesirably close toward the lower tip 178 of the cane 123 unless the predetermined length 176 is increased to allow the finger 135 to assume its full, spring-biased, opened position as shown in FIG. 8.

To increase or decrease the predetermined length 176, the locking clip 168 is pivoted to the release position shown in FIG. 10. The cord end portion 164 is then slid relative to the finger 135 so that an additional amount is added to or taken from the predetermined length 176 of the cord 151. A sufficient amount of the cord 151 has been added to or taken from the predetermined length 176 when the length 176 is taut and the finger 135 is spring biased into the desired open position. The cord is then resecured at its new predetermined length by returning the locking clip 168 to its secure position as shown in FIG. 7.

The cane 121 includes an annular groove 180 in the lower tip 178. The annular groove 180 is so located along the cane body 123 so that when the finger 135 is in the closed position, fingertip 182 engages the annular groove 180 as shown by the phantom lines of FIG. 8. Such engagement has the advantage of permitting certain objects to be retrieved more easily because they are pressed by the fingertip 182 into the groove 180 and thereby better resist dislodgement by gravity or inertial forces.

The operation of the cane 121 is apparent from the foregoing description. When the sleeve 142 is in the release zone 144 of the trigger 133, the user may pull on the trigger 133 to pivot it from its position shown in solid lines to that shown in phantom lines in FIG. 8. In response to such pivotal motion of the trigger 133, the finger 135 moves from its open position shown in solid lines toward its closed position shown in phantom lines. In this way, an object (not shown) may be retrieved and grasped between the inner surface 183 of the finger 135 and the lower tip 178 of the cane 121. If the object is malleable or planar, it may be held more securely if it is engaged between the finger 182 and the annular groove 180.

To adjust the amount of separation between the inner surface 183 and the lower tip 178, the locking clip 168 is pivoted from its secure position shown in FIGS. 7 and 8 to its release position shown in FIG. 10. To shorten the distance between the inner finger surface 183 and the lower tip 178, the finger 135 is pivoted toward the lower tip 178 by the desired amount, and the cord 151 is then pulled to take up any slack in the predetermined length 178. The locking clip 168 is returned to its secure position.

To adjust the overall length of the cane 121, the telescoping tubes of the elongated body 123 are adjusted relative to each other as discussed with reference to the previous embodiment. The predetermined length 176 of cord 151 is adjusted as discussed above so that the predetermined cord length 176 is taut when the finger 135 is in the desired position. As such, the length of the body 123 can be adjusted to any suitable length, and the grasping apparatus 147 can be readily adjusted so that it continues to function at any length of the cane body 123.

To lock the finger 135 in a predetermined position, such as the closed position shown in phantom lines in FIG. 8, the trigger 133 is pivoted to the position shown in solid lines in FIG. 9. The sleeve 142 is slid from its position shown in phantom lines in FIG. 8 into the locking zone 146 as shown in the solid lines of FIG. 9. This allows the grasping apparatus 147 to be made inoperative for those times when the user merely wishes to use the cane 121 for walking purposes.

In addition to the advantages apparent from the above description, the cane with grasping apparatus of the present invention eliminates the extreme inconvenience of a cane user retrieving and carrying a separate grasping device in order to reach desired objects.

The cane of this invention is lightweight by virtue of its hollow cane body, thereby allowing the device to be easily moved to reach objects and bring them to the user. This is especially important in the context of a cane, where the user may already be debilitated by the condition which has required the cane in the first place.

As yet another advantage, the grasping apparatus of the cane does not diminish the structural integrity or strength of the cane.

The cane has the advantage of being adjustable without impacting the operation of the grasping apparatus. The amount the finger opens can also be readily adjusted to suit the particular needs of the user.

The finger of the grasping apparatus has the advantage that it can be readily locked in a closed position, such as when it is not to be used. The locking is advantageously accomplished by means of simple manual movements which are generally performable even by those in a disabled or weakened condition.

As another advantage, the grasping apparatus is not only simple to manufacture, but it is located within the cane in such a manner as to be simple and straightforward to operate. The body of the cane substantially surrounds the grasping apparatus, thereby protecting it while the cane is moved about.

While the present invention has been described with reference to a preferred embodiment thereof, illustrated in the accompanying drawings, various changes and modifications can be made by those skilled in the art without departing from the spirit and scope of the present invention; therefore, the appended claims are to be construed to cover equivalent structures.

What is claimed is:

1. A cane comprising:

a) an elongated body having an upper end, a lower end, and an adjustable length, the body having a bore extending longitudinally therein;

b) a trigger pivotally mounted to the upper end of the body;

c) a finger pivotally mounted to the lower end of the body;

d) two pulleys mounted within the bore;

e) a flexible, elongated member operatively associated with the pulleys, the elongated member having opposing ends with one end connected to the trigger and the other end connected to the finger, so that the finger pivots when the trigger is caused to pivot;

f) a track disposed on the trigger, the track being displaced relative to the body when the trigger is pivoted, the track having a release zone and a locking zone, the locking zone located near the body when the trigger is in a predetermined position; and g) a slidable member mounted on the track and slidable between the two zones, the slidable member having surfaces which engage the body and the trigger when the slidable member is located in the locking zone and the trigger is in the predetermined position, thereby inhibiting pivotal motion of the trigger and locking the finger.

2. The cane of claim 1, wherein the trigger has opposite sides and an underside between the opposite sides adapted to engage a user's finger, and wherein the track extends along the underside and includes a flange extending from the opposite sides, and wherein the slidable member comprises a sleeve with a back and two arms, the arms and the back defining a slot therebetween which slideably engages the flange, the arms simultaneously engaging the body and the trigger when the sleeve is located in the locking zone and the trigger is in the predetermined position.

3. The cane of claim 1, wherein the finger is pivotable between an open and a closed position, and wherein the finger is locked in the closed position when the trigger is locked in the predetermined position.

4. The cane of claim 1 and further comprising a locking clip mounted to the finger and pivotable between first and second positions, the locking clip securing a predetermined length of the elongated member between the trigger and the finger when the locking clip is in the first position, the locking clip releasing the elongated member from the finger when the locking clip is in the second position, the elongated member being displaceable with respect to the locking clip when the locking clip is in the second position to permit adjustment of the predetermined length of the elongated member.

5. The cane of claim 4, wherein the finger is spring biased in an open position, whereby, when the length of the elongated body is adjusted, the finger may be maintained in the open position by adjusting the predetermined length of the elongated member.

6. The cane of claim 4, wherein the finger has inner and outer surface between the opposite sides, a bore extending between the inner and outer surfaces, and a ridge disposed on the outer surface, and wherein the flexible, elongated member comprises a cord, the cord passing from one of the pulleys through the bore, the end of the cord connected to the finger having a cord portion positionable at the ridge, and the locking clip engaging the ridge when in the first position to secure the cord portion between the ridge and the locking clip.

7. The cane of claim 6, wherein the locking clip has a base and a pair of laterally spaced locking clip arms, the base having an edge which engages the ridge when the locking clip is in the first position, the locking clip being mounted to the finger at the ends of the arms, the cord passing between the locking clip arms, the cord portion being securable between the edge and the ridge.

8. The cane of claim 1, wherein the lower end of the elongated body has an annular groove defined therein and wherein the finger terminates in a tip, the groove located to be engaged by the tip of the finger when the finger is in the closed position.

9. A cane comprising:

a) an elongated body having an upper end, a lower end, and an adjustable length, the body having a bore extending longitudinally therein;

b) a trigger pivotally mounted to the upper end of the body;

c) a finger pivotally mounted to the lower end of the body;

d) two pulleys mounted within the bore;

e) a flexible, elongated member operatively associated with the pulleys, the elongated member having opposing ends with one end connected to the trigger and the other end connected to the finger, so that the finger pivots when the trigger is caused to pivot; and f) a locking clip mounted to the finger and manually pivotable between a secure position and a release position, the locking clip securing a predetermined length of the member between the trigger and the finger when the locking clip is in the secure position, the locking clip releasing the member from the finger when the locking clip is in the release position, the member being slidable with respect to the locking clip when the locking clip is in the release position to permit adjustment of the predetermined length of the member.

10. The cane of claim 9, wherein the finger has inner and outer surfaces between the opposite sides, a bore extending between the inner and outer surfaces, and a ridge disposed on the outer surface, the elongated member passing from one of the pulleys through the bore, the end of the elongated member connected to the finger and having a portion positionable at the ridge, and the ridge located sufficiently close to the locking clip so that the ridge is engaged by the locking clip when in the secure position, thereby securing the portion between the ridge and the locking clip.

11. The cane of claim 9, wherein the locking clip has a base and a pair of laterally spaced locking clip arms, the base having an edge which engages the ridge when the locking clip is in the secure position, the locking clip being mounted to the finger at the ends of the arms, the elongated member passing between the locking clip arms, the portion being securable between the edge and the ridge.

12. A cane specially adapted to retrieve objects comprising:

a) an elongated body having an upper end, a lower end, and an adjustable length, the body having a bore extending longitudinally therein;

b) a grasping apparatus secured to the body, the grasping apparatus comprising a trigger and a finger, the trigger pivotally mounted to the upper end of the body, the finger pivotally mounted to the lower end of the body;

c) two pulleys mounted within the bore;

d) a cord operatively associated with the pulleys, the cord having opposing ends with one end connected to the trigger and the other end connected to the finger, so that the finger pivots when the trigger is caused to pivot;

e) a locking clip mounted to the finger and pivotable between a secure position and a release position, the locking clip securing a predetermined length of the cord between the trigger and the finger when the locking clip is in the secure position, the locking clip releasing the cord from the finger when the locking clip is in the release position, the cord being slidable with respect to the locking clip when the locking clip is in the release position to permit adjustment of the predetermined length of the cord;

f) a track disposed on the trigger, the track being displaced relative to the body when the trigger is pivoted, the track having a release zone and a locking zone, the locking zone located near the body when the trigger is in a predetermined position; and g) a member mounted on the track and slidable between the two zones, the member having surfaces which simultaneously engage the body and the trigger when the member is located in the locking zone and the trigger is in the predetermined position, thereby inhibiting pivotal motion of the trigger and locking the finger.

13. The cane of claim 12, wherein the elongated body comprises a pair of telescoping hollow tubes made of metal, the trigger and the finger being mounted about pins extending within each of the body, and further comprising means for adjusting the positions of the tubes relative to each other, and wherein the adjusting means, the pulleys, the pins and portions of the trigger and finger proximate to the pins are housed within the bore, the bore otherwise being unobstructed between the upper and lower ends of the body.

* * * * *